US006554021B1

(12) United States Patent
Sondov

(10) Patent No.: US 6,554,021 B1
(45) Date of Patent: Apr. 29, 2003

(54) APPARATUS FOR SHOCK-LIKE FLUSHING IN A LIQUID SYSTEM

(75) Inventor: Sten Y. Sondov, Tønsberg (NO)

(73) Assignee: Cleanpipe As, Tønsberg (NO)

( * ) Notice: Subject to any disclaimer, the term of this patent is extended or adjusted under 35 U.S.C. 154(b) by 0 days.

(21) Appl. No.: 09/889,357

(22) PCT Filed: Jan. 25, 2000

(86) PCT No.: PCT/NO00/00016

§ 371 (c)(1),
(2), (4) Date: Sep. 19, 2001

(87) PCT Pub. No.: WO00/44999

PCT Pub. Date: Aug. 3, 2000

(30) Foreign Application Priority Data

Jan. 28, 1999 (NO) ..... 19990423

(51) Int. Cl.[7] ..... E03F 5/10
(52) U.S. Cl. ..... 137/396; 137/597
(58) Field of Search ..... 137/396, 403, 137/578, 579

(56) References Cited

U.S. PATENT DOCUMENTS 741,203 A * 10/1903 Williams ..... 137/152
2,307,324 A * 1/1943 Larson ..... 137/357
3,843,976 A 10/1974 Miya et al.
4,305,426 A * 12/1981 Scheid et al. ..... 137/578
4,321,948 A 3/1982 Bradley
5,290,434 A 3/1994 Richard
6,449,781 B1 * 9/2002 Sondov ..... 137/579

FOREIGN PATENT DOCUMENTS

| | | |
|---|---|---|
| DE | 36 10 737 A1 | 10/1987 |
| FR | 2 720 424 A1 | 12/1995 |
| GB | 1 441 631 | 7/1976 |
| WO | WO 89/03917 A1 | 5/1989 |
| WO | WO 00/14347 A1 | 3/2000 |

* cited by examiner

*Primary Examiner*—John Fox
(74) *Attorney, Agent, or Firm*—Rothwell, Figg, Ernst & Manbeck

(57) ABSTRACT

Apparatus for shock-like flushing in a liquid system, comprising an accumulating or blocking element (11, 12, 13) which upon supply of liquid from an inlet (7) is adapted to be set from a normal position to a flushing position accummulated liquid flows through an outlet (6B, 6, 6A) to a following section of the liquid system, and subsequently to be ret to normal position. The blocking element (11, 12, 13) is held in an inclined position (11', 12', 13') by means of spring or weight load (21, 22, 23) until a certain level of accumulated liquid is attained, and the spring or weight load (21, 22, 23) is adapted to bring the blocking element (11, 12, 13) back from the flushing position to normal inclined position when a certain low liquid level is attained. The blocking outlet (6B, 6, 6A) respectively, through flexible tube sleeves (15, 14) which make possible the movement of the U-tube (11, 12, 13) between the two positions for accumulation and flushing, respectively.

9 Claims, 3 Drawing Sheets

APPARATUS FOR SHOCK-LIKE FLUSHING IN A LIQUID SYSTEM

Figure 1:
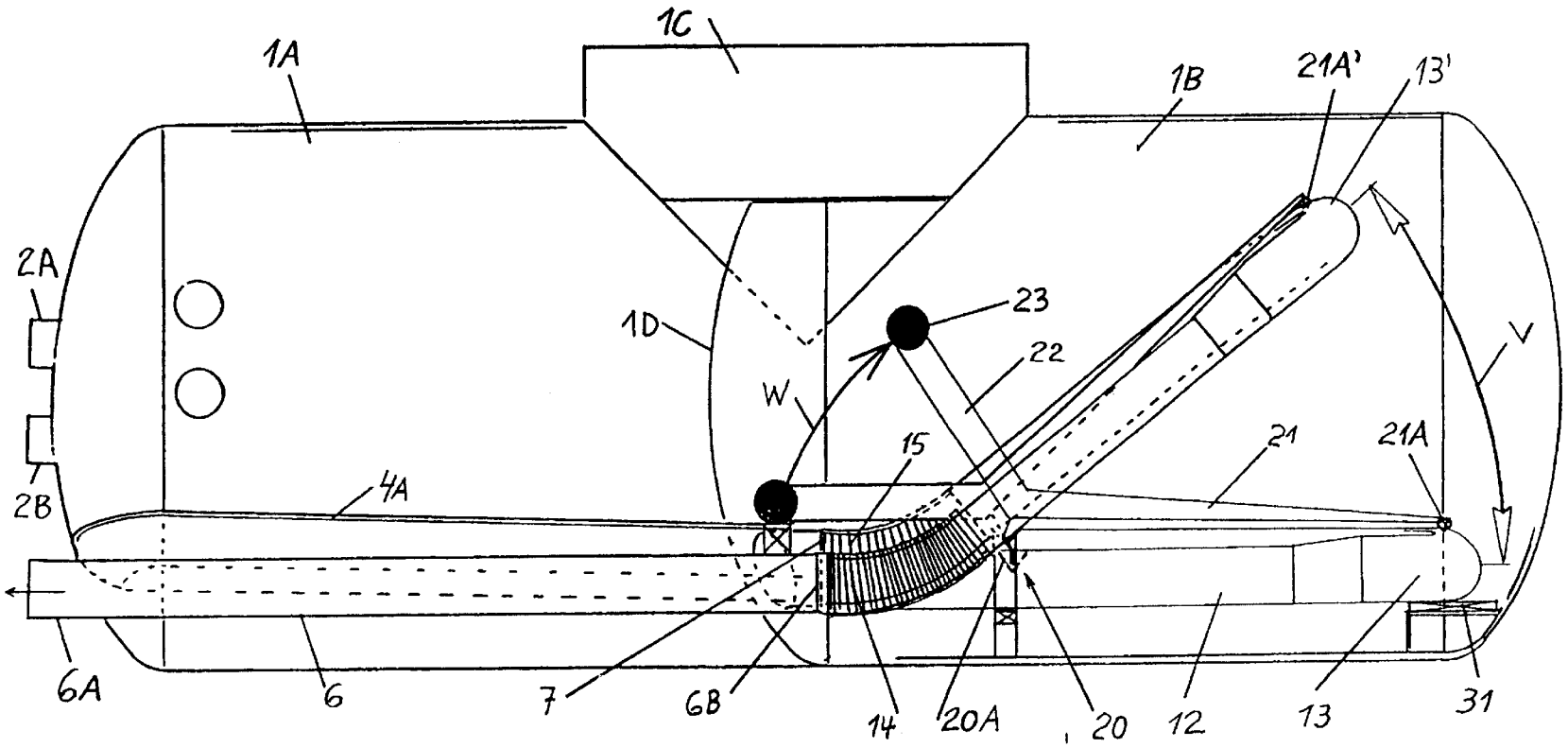

This invention relates to an apparatus for shock-like flushing in a liquid system, in particular waste water and sewage systems that among other things can receive waste water from houses.

In waste water and sewage systems there is in many places a need for so-called "shock-flushing apparatuses", i.e. installations bringing about a shock-like discharge of accumulated waste water into following parts of a pipe network or system. Of particular interest in the present context are the outer or upper ends of a waste pipe serving a number of housing units. In such situations the total waste water volume from the housing units will often be so low and varying that a shock-flushing apparatus is highly desired in order to avoid deposition and clogging in the downstream pipe network. As it is known, such problems are frequent when throughout a longer period of time only small amounts of waste water or sewage flow through the pipes.

Shock-flushing apparatuses in various forms are previously known, for example from:

French patent 2,720,424,

U.S. Pat. Nos. 4,321,948 and 5,290,434 and 3,843,976,

British patent 1.441.631,

German patent 3.610.737,

International patent publication WO 89/03917 and PCT/NO98/00269.

The previously known solutions have shortcomings and drawbacks being among other things related to the following:

Movable parts being subjected to the waste water or liquid containing various substances and pollutants that lead to soiling and fouling of movable parts so that these with time are subject to malfunction.

More or less irregular surfaces delimiting the liquid flow, for example in flexible, corrugated pipe members which are also subject to depositions and fouling, and relatively complicated structures in the purely mechanical sense, so that the reliability during long period operations is not satisfactory.

Particularly in the above case of a relatively small number of housing units at the end of a waste water or sewage pipe, there is a requirement for a solution adapted to the situation, making it adequate in technical and economical terms to install a shock-flushing apparatus at the desired location. The space conditions are also very significant in this connection.

Thus, on the above background the invention is more closely directed to an apparatus for shock-like flushing in a liquid system, comprising an accumulating or blocking element which upon supply of liquid from an inlet is adapted to be set from a normal position to a flushing position where accumulated liquid flows through an outlet to a following section of the liquid system, and subsequently to be reset to normal position, where the blocking element is held in an inclined position by means of a spring or weight load until a certain level of accumulated liquid is attained, and the spring or weight load is adapted to bring the blocking element back from the flushing position to normal inclined position when a certain low liquid level is attained.

What is novel and specific in the apparatus according to the invention consists in the first place therein that the blocking element is formed essentially as a U-shaped tube the two ends of which are tightly connected to the inlet and the outlet, respectively, through flexible tube sleeves which make possible the movement of the U-tube between the two positions for accumulation and flushing, respectively.

Advantageously such an apparatus can be integrally mounted in a two-part tank at the end of a waste water pipe as discussed above, whereby an upstream part of the tank serves for accumulating waste water from the houses, whereas an adjacent, downstream tank part contains the movable components of the shock-flushing apparatus, namely in the first place the U-shaped tube and means for spring or weight loading of the U-tube.

Among the advantages of the apparatus conserned, reference is made to a favourable design of the flow path through the movable U-tube, at the same time as this requires comparatively little space. Moreover, there is here the question of a closed, movable U-tube, that with its flexible connections to the inlet and the outlet, respectively, constitutes a very reliable conponent in the apparatus.

Figure 2:
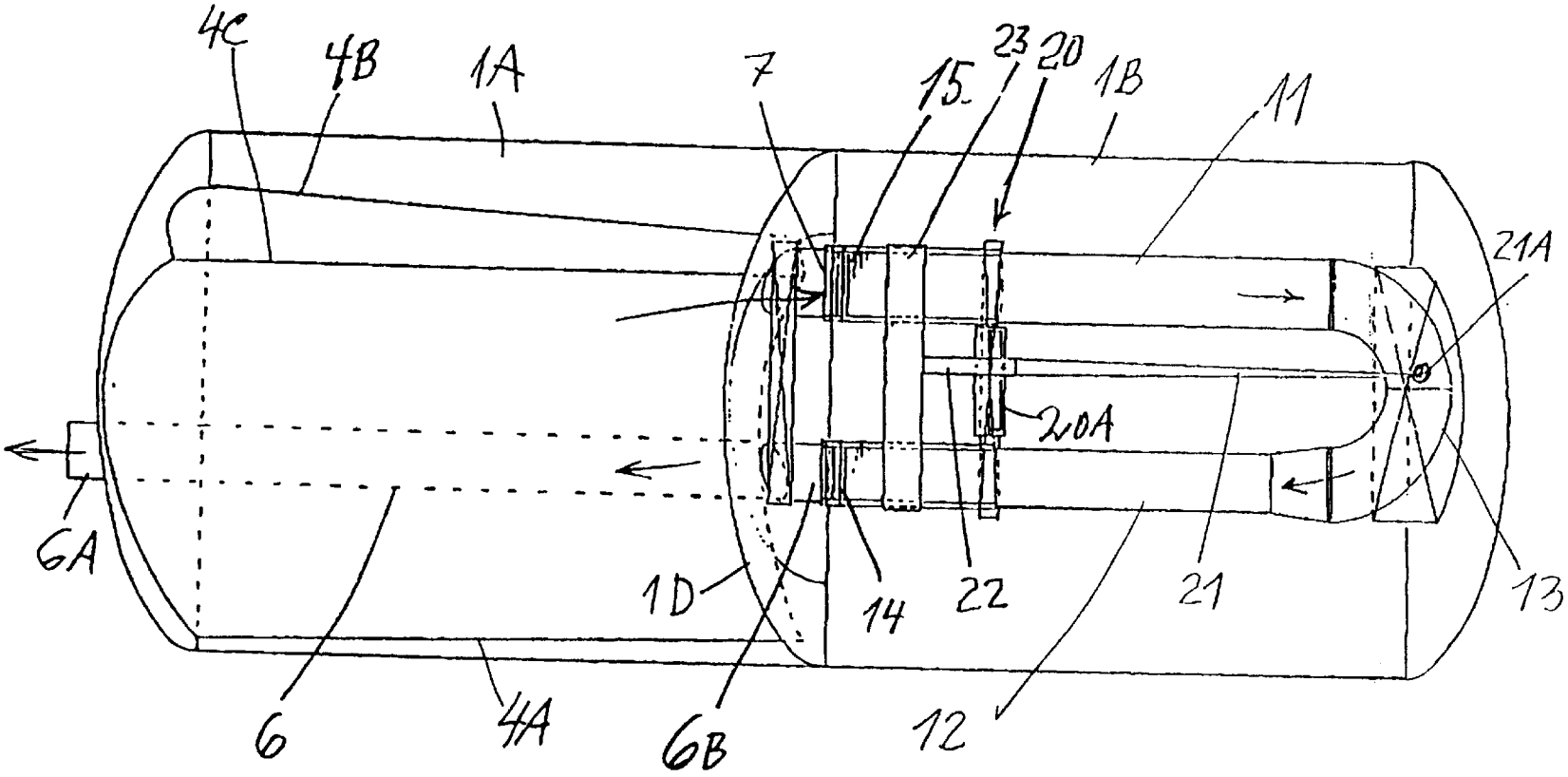
Figure 3:
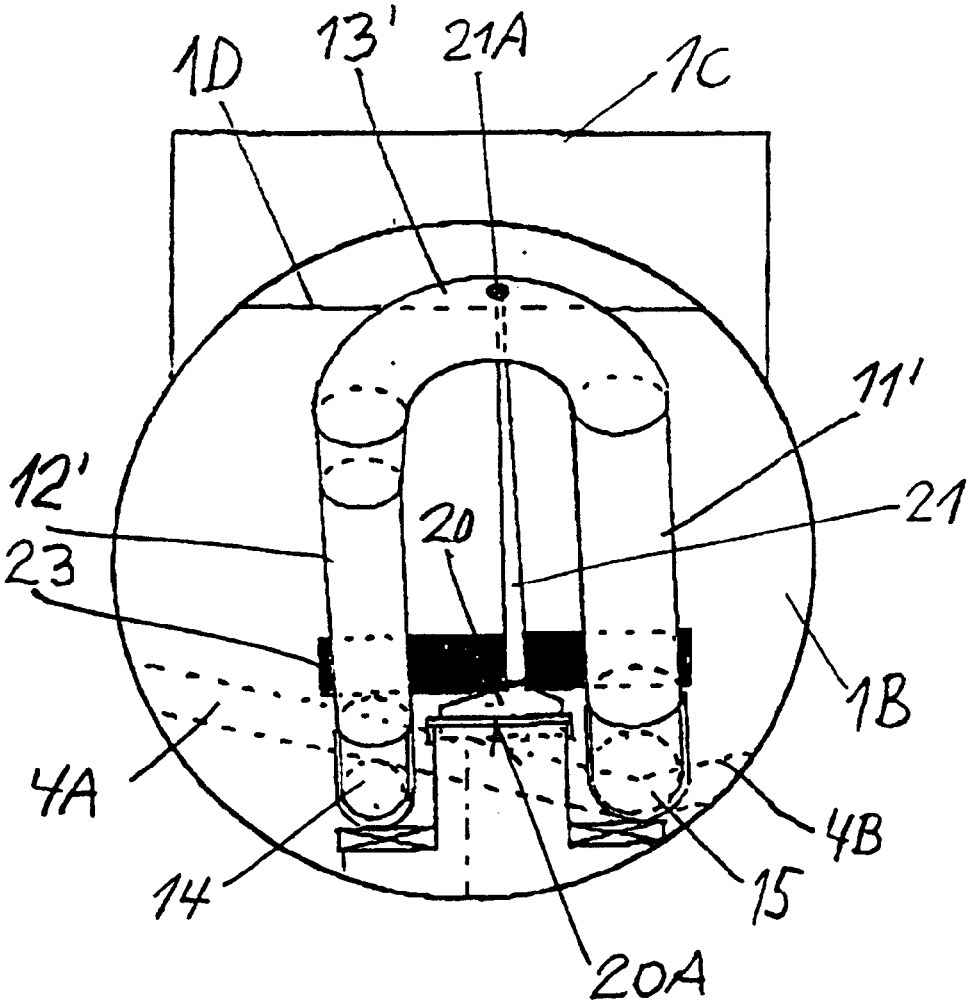

Other specific features and advantages of the apparatus according to the invention will be seen from the following more detailed description with reference to the drawings, where:

FIG. 1 in partial and axial vertical section shows a tank provided with an apparatus according to the invention, FIG. 2 shows a corresponding horizontal longitudinal section with the U-tube in flushing position, and FIG. 3 in partial cross-section shows the apparatus of FIGS. 1 and 2 with the U-tube in accumulating or blocking position.

As will be seen from FIGS. 1 and 2 there is here the question of a tank having two parts 1A and 1B with an intermediate partition 1D. In a usual manner the tank has a manhole 1C on top. The installation can be particularly suitable for use at an outer end of a pipe or sewage network, where waste water from a number of surrounding housing units can be led into tank part 1A through supply sockets, two of which are shown at 2A and 2B in FIG. 1. Accordingly, tank part 1A here constitutes a collecting tank for the purpose of shock-like flushing therefrom into the following pipe network.

A main component in tank part 1B is a U-shaped tube 30 having legs 11 and 12 as well as a curved tube portion 13 which results in turning of the water flow by about 180°. The U-tube 11, 12, 13 is movable in tank part 1B between a normal inclined position as indicated with referance numeral 13' i FIG. 1, and a lowered flushing position as also shown in FIG. 1. In the latter position the entire U-tube runs preferably at a slight slope from its inlet 7 to its outlet at 6B, continuing in the form of an outlet pipe 6 having a connection at 6A to the following pipe network. In the flushing position the tube portion 13 is supported on a rubber plate 31 which constitutes a shock-absorbing stop element for this tube position.

In the blocking inclined position (13' in FIG. 1, 11', 12', 13' in FIG. 3) the U-tube is held up by means of weight loading based on a weight 23 on an angled lever 22, 21 having an axis of rotation as indicated at 20. At the outer end of arm 21 there is shown a supporting element 21A connected to tube portion 13. In the inclined position shown the U-tube will block for discharge flow from collecting tank part IA until the liquid level therein has risen so high that the corresponding liquid level in the first U-member 11 will overcome the moment from the weight loading and will quickly swing the whole U-tube down to the flushing position described. Thus, during this swinging or lowering movement the U-tube moves through an angle V whereas the weight lever 22 with weight 23 simultaneously moves over an equally large angle W, as indicated in FIG. 1.

It is a substantial feature of the structure shown that the first U-member 11 is connected through a flexible tube sleeve 15 to the inlet 7 from tank part 1A, and that the other U-member 12 has an outlet through a corresponding flexible tube sleeve 14 which in turn is tightly connected to a junction or tube socket 6B that continues in the form of the outlet pipe 6 to 6A for discharging waste water in a shock-like manner to the following pipe network. FIG. 1 clearly shows how the two flexible sleeves 14 and 15 are bent to the normal inclined position of blocking element 11, 12, 13 for accumulating liquid in tank part 1A. In the flushing position as illustrated in FIG. 2, it is indicated with arrows how discharge flow takes place through U-tube 11, 12, 13 and further through the above outlet 6B, 6, 6A from the apparatus.

Furthermore FIG. 2 shows that U-member 11 has a larger tubular cross section than U-member 12, and that the same applies to the curved portion 13. These dimensional relationships are significant, inter alia, for the lowering moment that results from an increasing liquid level in U-member 11 in the normal inclined position for accumulating water. It is apparently an advantage that a larger volume of liquid in this tube member will increase the moment leading to lowering of the whole U-tube when a certain level has been reached. Besides it is a favourable solution with respect to the flow conditions that also the curved portion 13 of the U-tube has an increased flow cross section in relation to the following tube member 12. The flexible sleeves 14 and 15 are of course also adjusted in terms of dimensions in relation to the respective tube members 12 and 11.

Another important factor regarding U-tube 11, 12, 13 appears in particular from FIG. 3, namely that sleeve 15 at inlet 7 lies at a somewhat higher level than sleeve 14 at outlet 6B. Then there can be provided for a slope of the U-tube as a whole through all of its length from the upstream end to the downstream end when the tube is in the flushing position. This means that the centre axis through the various portions of the U-tube does not strictly speaking lie in a common plane. FIG. 1 also illustrates this.

With the slanting position of U-tube 11, 12, 13 as just explained, it is expedient that also the journalling and the swinging or tilting movement of weight lever 21, 22 with weight 23 takes place in the same plane as the lowering movement of the U-tube. FIG. 3 shows a bearing or a cradle 20A for the weight lever, the rotational axis of which is also indicated at 20 in FIG. 1 and FIG. 2. The cradle 20A can suitably be in the form of an opwardly open V-profile as shown somewhat schematically in FIG. 1. In this V-profile there is also placed a transverse element in the form of a flat iron or the like, being rigidly connected to weight arm 21, 22. The transverse element is maintained in its place in the V-profile as a consequence of the weight of weight lever 21, 22 with associated weight 23 as well as the load imposed by the tube portion 13 at support element 21A. The journalling referred to here constitutes a robust and simple structure that is advantageous under the conditions for which the apparatus is intended.

As will be seen in particular from FIGS. 2 and 3 the weight lever system with arm member 21 is somewhat laterally offset in relation to the central tilt plane of U-tube 11, 12, 13. This small lack of symmetry has to do with the above mentioned dimensional relationship between U-members 11 and 12, whereby U-member 11 will be heavier than U-member 12.

In the above description there has been referred to a shock-absorbing plate 31 for tube portion 13 in its flushing position. Corresponding stop or absorbent elements can also be provided at other points, such as beneath weight 23 in the normal inclined position. In addition to defining exactly the angular position concerned, such absorbent stop elements serve to avoid shock-like stresses in the structural members when the movements of the U-tube and the weight load are terminated in the extreme positions, namely the accumulating position and the flushing position, respectively.

With the integrated arrangement of U-tube 11, 12, 13 in a two-part tank 1A, 1B it is moreover advantageous to have a particular bottom structure in tank part 1A. At the bottom thereof bottom plates 4A and 4B are shown, both being inclined at a very open V-shape as will be seen in particular from FIG. 3. Thus, there is formed a sump or drain 4C that is directed towards inlet 7 in order that as much as possible of accumulated waste water or liquid in connecting tank part 1A shall be able to flow out through the U-tube during flushing. Thus, the drain portion 4C will be designed with a slope in a direction towards inlet 7 at the flexible tube sleeve 15. The double bottom structure as described here (and being known per se) is utilized also with advantage for extending the outlet pipe 6 out of the tank at 6A at the underside of bottom plate 4A, as will be seen in particular from FIG. 1.

A favourable more simple and cheaper solution than the double bottom as just explained, can be provided in a two-part tank where the bottom of the collecting tank lies at a higher level than the bottom of the tank part for the U-tube. Then the outlet pipe can extend underneath the collecting tank while maintaining a similar configuration as in FIG. 1. Also in the case of such a solution there should be provided for a slope in the bottom of the colleting tank in a direction towards the inlet to the U-tube.

Another possible, modified embodiment can comprise a U-tube formed of a flexible pipe length being provided with stiffening means or a supporting frame maintaining the pipe length in the desired U-shape. Additional modifications can be contemplated as regards the weight loading, that can be arranged in other manners than with an angled lever as described and illustrated. Spring loading or action is also possible for obtaining the desired movements of the U-tube.

What is claimed is:

1. Apparatus for shock-like flushing in a liquid system, comprising an accumulating or blocking element (11,12,13) which upon supply of liquid from an inlet (7) is adapted to be set from a normal position to a flushing position where accumulated liquid flows through an outlet (6B,6,6A) to a following section of the liquid system, and subsequently to be reset to normal position, where the blocking element (11,12,13) is held in an inclined position (11',12'13') by means of spring or weight load (21,22,23) until a certain level of accumulated liquid is attained, and the spring or weight load (21,22,23) is adapted to bring the blocking element (11,12,13) back from the flushing position to normal inclined position when a certain low liquid level is attained, characterized in that the blocking element is formed essentially as a U-shaped tube (11,12,13) the two ends of which are tightly connected to the inlet (7) and the outlet (6B,6,6A) respectively, through flexible tube sleeves (15,14) which make possible the movement of the U-tube (11,12,13) between the two positions for accumulation and flushing, respectively.

2. Apparatus according to claim 1, characterized in that the inlet (7) is located at a higher level than the outlet (6B,6,6A) and that the U-tube (11,12,13) in the flushing position has a slope substantially along its whole length from the upstream end to the downstream end.

3. Apparatus according to claim 1, characterized in that a first tube member (11) of the U-tube has a larger flow cross section than a subsequent second tube member (12) as seen in the flow direction during flushing.

4. Apparatus according to claim 3, characterized in that said first tube member with a larger flow cross section comprises an intermediate curved portion (13) of the U-tube (11,12,13).

5. Apparatus according to claim 1, characterized in that there is incorporated at least one shock absorbent stop element (31) for the spring or weight load and/or the U-tube (11,12,13) in the accumulating position and/or the flushing position.

6. Apparatus according to claim 1, characterized in that the inlet (7) communicates with a collecting tank part (1A) which is provided with a number of supply openings (2A, 2B) for waste water, and that the outlet (6,6A) is extended through the collecting tank part (1A) near the bottom thereof.

7. Apparatus according to claim 6, characterized in that the collecting tank part (1A) is provided with bottom plates (4A,4B) having an open V-shape and lying over the outlet (6,6A) as well as having a lower, drain-like portion (4C) with a slope towards the inlet (7).

8. Apparatus according to claim 1, characterized in that the inlet communicates with a collecting tank part provided with a number of supply openings for waste water and with a bottom preferably having a slope towards the inlet and lying at least partially at a higher level than the outlet, so that an outlet pipe can be extended at the underside of the collecting tank part.

9. Apparatus according to claim 1 and having a weight load, characterized in that an angled lever (21,22) for a weight (23) that constitutes the weight load, is journalled in an upwardly open, V-shaped cradle (20A) extending transversally to the angled lever (21,22).

* * * * *